US011332345B2

(12) United States Patent
Xiong et al.

(10) Patent No.: US 11,332,345 B2
(45) Date of Patent: May 17, 2022

(54) ELEVATOR SYSTEM WITH OPTIMIZED DOOR RESPONSE

(71) Applicant: Otis Elevator Company, Farmington, CT (US)

(72) Inventors: Ziyou Xiong, Wethersfield, CT (US); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 952 days.

(21) Appl. No.: 16/059,816

(22) Filed: Aug. 9, 2018

(65) Prior Publication Data

US 2020/0048045 A1 Feb. 13, 2020

(51) Int. Cl.

| | |
|---|---|
| ***B66B 13/14*** | (2006.01) |
| ***B66B 1/24*** | (2006.01) |
| ***B66B 5/00*** | (2006.01) |
| ***B66B 13/26*** | (2006.01) |

(52) U.S. Cl.

CPC ..... *B66B 13/146* (2013.01); *B66B 1/2408* (2013.01); *B66B 5/0012* (2013.01); *B66B 13/26* (2013.01)

(58) Field of Classification Search

CPC ... B66B 13/146; B66B 1/2408; B66B 5/0012; B66B 13/26

USPC ..... 187/316

See application file for complete search history.

(56) References Cited

U.S. PATENT DOCUMENTS

| | | | | |
|---|---|---|---|---|
| 5,286,930 | A * | 2/1994 | Bittar | B66B 13/146 187/316 |
| 5,387,768 | A * | 2/1995 | Izard | G06F 7/00 187/392 |
| 7,712,586 | B2 | 5/2010 | Legez | |
| 7,743,891 | B2 | 6/2010 | Tyni et al. | |
| 2003/0168288 | A1 * | 9/2003 | Deplazes | B66B 13/26 187/317 |

(Continued)

FOREIGN PATENT DOCUMENTS

| | | | |
|---|---|---|---|
| CN | 1077431 | A | 10/1993 |
| CN | 101058381 | A | 10/2007 |

(Continued)

OTHER PUBLICATIONS

European Search Report for application EP 19190877.1, dated Dec. 9, 2019, 104 pages.

Chinese Office Action for Application No. 201910729137.3; dated Jun. 25, 2021; 8 Pages.

*Primary Examiner* — Jeffrey Donels

(74) *Attorney, Agent, or Firm* — Cantor Colburn LLP

(57) ABSTRACT

A method and system for controlling a movable door associated with a passenger compartment, the door moveable between an opened position and a closed position configured to provide access to, or egress from, the passenger compartment. The method includes monitoring a landing area of the elevator door with at least one sensor, and determining a level of urgency of an approaching passenger based on the information from the at least one sensor. If the level of urgency exceeds a predetermined threshold, modifying a closing of the elevator door based on the level of urgency. The method may also include modifying a closing speed of the elevator door if the level of urgency exceeds a predetermined threshold.

18 Claims, 4 Drawing Sheets

(56) References Cited

U.S. PATENT DOCUMENTS

| | | | | |
|---|---|---|---|---|
| 2006/0037818 | A1* | 2/2006 | Deplazes | G08B 13/1961 187/392 |
| 2009/0057068 | A1* | 3/2009 | Lin | B66B 1/468 187/392 |
| 2016/0031675 | A1* | 2/2016 | Silvennoinen | G05B 15/02 187/247 |
| 2016/0052748 | A1 | 2/2016 | Siikonen et al. | |
| 2016/0289043 | A1* | 10/2016 | Fang | B66B 1/3461 |
| 2016/0289044 | A1 | 10/2016 | Hsu et al. | |
| 2016/0291558 | A1 | 10/2016 | Finn et al. | |
| 2016/0292522 | A1 | 10/2016 | Chen et al. | |
| 2016/0347577 | A1 | 12/2016 | Simcik et al. | |
| 2016/0368732 | A1* | 12/2016 | Zhao | B66B 1/468 |
| 2017/0081148 | A1 | 3/2017 | Salmikuukka | |
| 2017/0197807 | A1* | 7/2017 | Noda | B66B 13/143 |

FOREIGN PATENT DOCUMENTS

| | | | |
|---|---|---|---|
| CN | 101304939 | A | 11/2008 |
| CN | 103663068 | A | 3/2014 |
| CN | 105775973 | A | 7/2016 |
| JP | H05278977 | A | 10/1993 |
| JP | 2003341963 | A | 12/2003 |
| JP | 2009242045 | A | 10/2009 |
| JP | 2013199334 | A | 10/2013 |
| JP | 2014181124 | A | 9/2014 |
| JP | 2018030676 | A | 3/2018 |

* cited by examiner

ELEVATOR SYSTEM WITH OPTIMIZED DOOR RESPONSE

BACKGROUND

The embodiments herein relate to elevator systems and, more particularly, automated door systems with response times optimized for approaching passengers.

Current door systems require obstruction detection in the closing door plane, leading to passengers putting their hand into the door path to stop the door. On occasion, this may lead to a passenger intentionally or inadvertently contacting the door. Elevator doors are typically equipped with detection components that only monitor for objects in the plane of the elevator door.

Currently elevator doors are opened or closed at a speed that is independent of the movement speed of an approaching passenger. The speed is also independent of the button-pressing frequency or force of the passenger when he/she issues a car call. It is desirable to have an adaptive door response system and method in which an estimate of a passenger's moving speed or state-of-urgency can be used to adaptively set the speed that an elevator door responds to the passenger.

BRIEF SUMMARY

Disclosed herein in an embodiment is a method and system for controlling a movable door associated with a passenger compartment, the door is moveable between an opened position and a closed position configured to provide access to, or egress from, the passenger compartment. The method includes monitoring a landing area of the elevator door with a sensor, and determining a level of urgency of an approaching passenger based on the information from the sensor. If the level of urgency exceeds a predetermined threshold, the method includes modifying a closing timing of the elevator door based on the level of urgency. In addition, the method may also include modifying a closing speed of the elevator door if the level of urgency exceeds a predetermined threshold.

Also disclosed herein in an embodiment is a passenger detection system for controlling a movable door associated with a passenger compartment. The system includes a door moveable between an opened position and a closed position configured to provide access to, or egress from, the passenger compartment, at least one sensor monitoring an area in proximity to the door; and a controller in operative communication with the at least one sensor and the door. The controller determines a level of urgency of an approaching passenger based on the information from the at least one sensor, including at least one of the speed of the approaching passenger, a distance of the approaching passenger from the elevator, and a button press frequency and duration. If the level of urgency exceeds a first predetermined threshold, modifying a closing of the elevator door based on the level of urgency.

In addition to one or more of the features described above, or as an alternative, further embodiments may include that the modifying a closing of the elevator door includes at least one of changing timing of closing movement, reducing a speed of the door closing movement, stopping the door closing movement, and reversing the door closing movement.

In addition to one or more of the features described above, or as an alternative, further embodiments may include that the modifying a closing timing includes delaying a closing movement of the door.

In addition to one or more of the features described above, or as an alternative, further embodiments may include that the at least one sensor is at least one of an infrared sensor, a radar sensor, a video sensor, a time of flight sensor, depth sensor, and a LIDAR sensor.

In addition to one or more of the features described above, or as an alternative, further embodiments may include that the area the at least one sensor is monitoring located at an exterior of the passenger compartment.

In addition to one or more of the features described above, or as an alternative, further embodiments may include that the area the at least one sensor is monitoring is located at an interior of the passenger compartment.

In addition to one or more of the features described above, or as an alternative, further embodiments may include at least one of modifying a closing speed of the elevator door if the level of urgency exceeds a second predetermined threshold and reversing a closing movement of the elevator door if the level of urgency exceeds a third predetermined threshold.

In addition to one or more of the features described above, or as an alternative, further embodiments may include that the level of urgency is based on at least one of the gait or pace of the approaching passenger.

In addition to one or more of the features described above, or as an alternative, further embodiments may include that the passenger compartment is an elevator car and the door is an elevator door.

In addition to one or more of the features described above, or as an alternative, further embodiments may include that the at least one sensor is fixed to one of the elevator door, the leading edge of the elevator door, and a fixed structure in a landing area located proximate the elevator door.

Also described herein in an embodiment is a method of controlling a movable door associated with a passenger compartment, the door moveable between an opened position and a closed position configured to provide access to, or egress from, the passenger compartment. The method includes monitoring a landing area of the elevator door with at least one sensor, determining a level of urgency of an approaching passenger based on the information from the at least one sensor. The level of urgency is based on at least one of the speed of the approaching passenger, distance of the approaching passenger from the elevator, button press frequency and duration. If the level of urgency exceeds a predetermined threshold, the method also includes modifying a closing of the elevator door based on the level of urgency.

In addition to one or more of the features described above, or as an alternative, further embodiments of the method may include modifying a closing of the elevator door includes at least one of: changing timing of closing movement, reducing a speed of the door closing movement, stopping the door closing movement, and reversing the door closing movement.

In addition to one or more of the features described above, or as an alternative, further embodiments of the method may include that modifying a closing timing includes delaying a closing movement of the door.

In addition to one or more of the features described above, or as an alternative, further embodiments of the method may include that the at least one sensor comprises at least one of an infrared sensor, a radar sensor, a video sensor, a time of flight sensor, a depth sensor, and a LIDAR sensor.

In addition to one or more of the features described above, or as an alternative, further embodiments of the method may include that the monitoring a landing area is an area located at an exterior of the passenger compartment.

In addition to one or more of the features described above, or as an alternative, further embodiments of the method may include that the monitoring is a landing area is an area located at an interior of the passenger compartment.

In addition to one or more of the features described above, or as an alternative, further embodiments of the method may include at least one of modifying a closing speed of the elevator door if the level of urgency exceeds a second predetermined threshold; and reversing a closing movement of the elevator door if the level of urgency exceeds a third predetermined threshold.

In addition to one or more of the features described above, or as an alternative, further embodiments of the method may include that the level of urgency is based on at least one of the gait or pace of the approaching passenger.

In addition to one or more of the features described above, or as an alternative, further embodiments of the method may include that the passenger compartment is an elevator car and the door is an elevator door.

In addition to one or more of the features described above, or as an alternative, further embodiments of the method may include that the at least one sensor is fixed to one of the elevator door, the leading edge of the elevator door, and a fixed structure in a landing area located proximate the elevator door.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Described herein in one or more embodiments is an elevator system using sensors to estimate a passenger's state-of-urgency in approaching an elevator. For example, in one embodiment, by extracting the speed of an approaching passenger from sensed data. In an exemplary embodiment, the sensor can be a camera, and include a one-dimensional (1D), 2D, 3D sensors and/or a combination and/or array thereof. Sensors may be operable in the electromagnetic or acoustic spectrum capable of producing a 3D point cloud, occupancy grid or depth map of the corresponding dimension(s). Sensor may provide various characteristics of the sensed electromagnetic or acoustic spectrum including intensity, spectral characteristics, polarization, etc. that may then be correlated to the estimating a state-of-urgency of an approaching passenger.

Figure 1A:
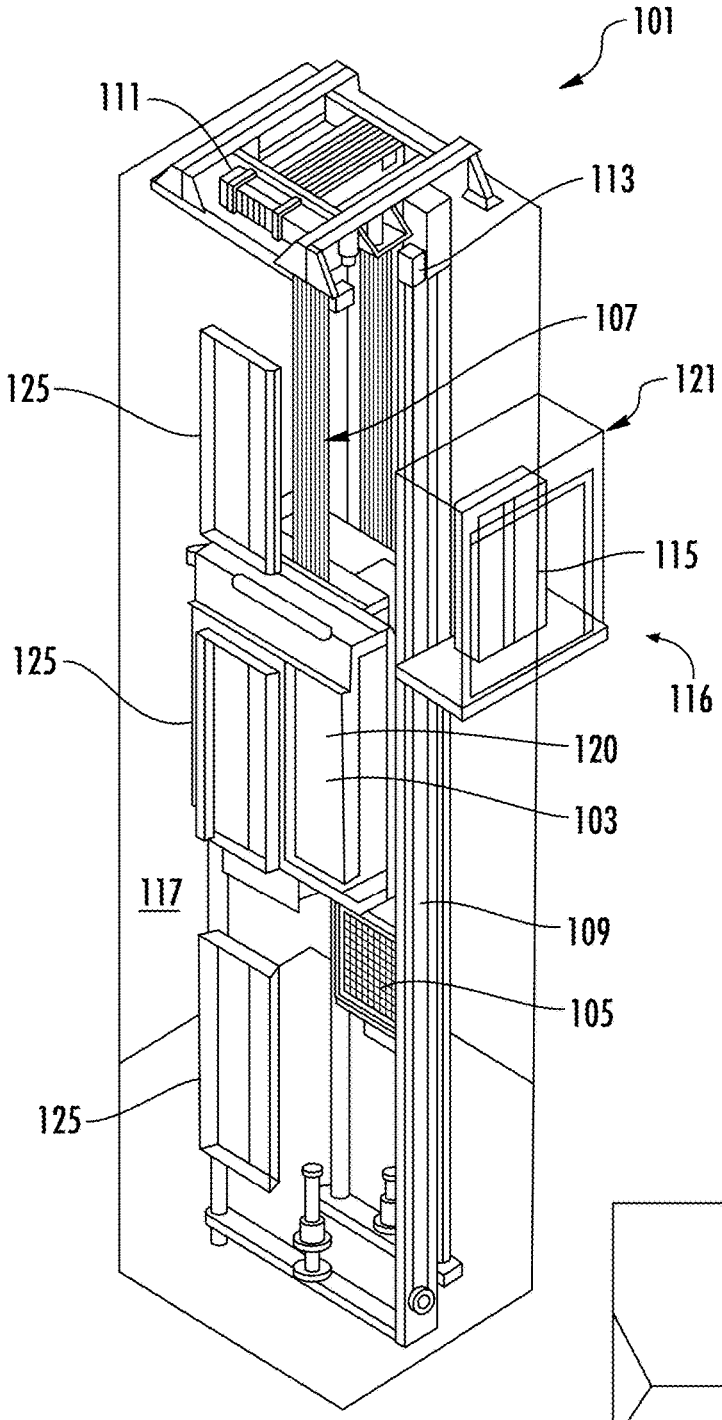
FIG. 1A is a schematic illustration of an elevator system that may employ various embodiments of the present disclosure.

FIG. 1A is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail 109, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car 103 and/or counter weight 105, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. In addition, the controller 115 may be part of a control system 116 configured to interface with various sensors e.g. 162 (FIG. 1B), buttons/switches 126 and the like to facilitate operation of various aspects of the elevator system 101. Although shown in a controller room 121, those of skill in the art will appreciate that the controller 115 and/or control system 116 can be located and/or configured in other locations or positions within the elevator system 101. In one embodiment, the controller may be located remotely or in the cloud computing environment.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car 103 within an elevator shaft 117 may employ embodiments of the present disclosure. For example, embodiments may be employed in ropeless elevator systems using a linear motor to impart motion to an elevator car 103. Embodiments may also be employed in ropeless elevator systems using a hydraulic lift to impart motion to an elevator car 103. FIG. 1A is merely a non-limiting example presented for illustrative and explanatory purposes.

The overall amount of travel time a passenger associates with elevator performance may include three time intervals. A first time interval can be the amount of time a passenger waits in a lobby for an elevator car 103 to arrive, hereafter the "wait time." A second time interval can be the "door dwell time" or the amount of time the elevator doors 120 are open, allowing passengers to enter or leave the elevator car 103. A third time interval can be the "ride time" or amount of time a passenger spends in the elevator car 103. The ride time can also include a stop on an intermediate floor to allow passengers to enter and/or exit the elevator which can add to the ride time by at least the door dwell time during the stop.

Figure 1B:
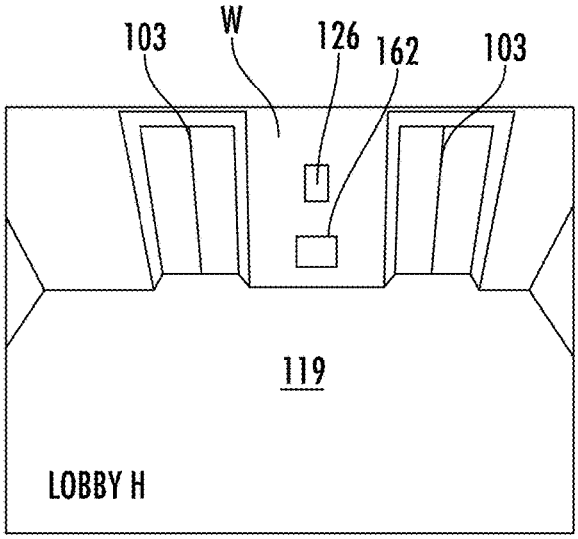
FIG. 1B is a depiction of an elevator landing in accordance with an embodiment.

Turning now to FIG. 1B, various elevator systems 101 can utilize a passenger-initiated input to signal the need for service. For example, input from the lobby call panel 126 may include a push button, e.g., up, down, or desired destination, to request elevator service. The passenger initiated input (e.g., via a call button 126) may notify the controller 115 of the presence of a passenger awaiting elevator service. In response, the controller 115 may dispatch the elevator car 103 to the appropriate floor. Optionally, once inside the elevator car 103, the passenger may push a button on the car-operating panel (COP) (not shown) designating the desired destination, direction, or the like, and then the controller 115 may dispatch the elevator car 103 to that destination.

The controller 115 and/or 118 (See FIGS. 2 and 3) may include a processor, a memory, and communications and I/O interface. The controllers 115, 118 can include a portion of a central control, a stand-alone unit, or other system such as a cloud-based system. The processor can include any type of microprocessor having desired performance characteristics, such as a microcontroller, digital signal processor, application specific integrated circuit, programmable logic device, and/or field programmable gate array. The memory may include any type of computer readable medium that stores the data and control processes disclosed herein. That is, the memory is an example computer storage media that can have embodied thereon computer-useable instructions such as a process that, when executed, can perform a desired method. The interface of the controller 115, 118 can facilitate communication between the controller 115, 118 and other components or systems. The communication module may implement one or more communication protocols, e.g., Ethernet, WiFi, Bluetooth, cellular and the like, and may include features to enable wireless communication with external and/or remote devices separate from the controller 115, 118.

Figure 2:
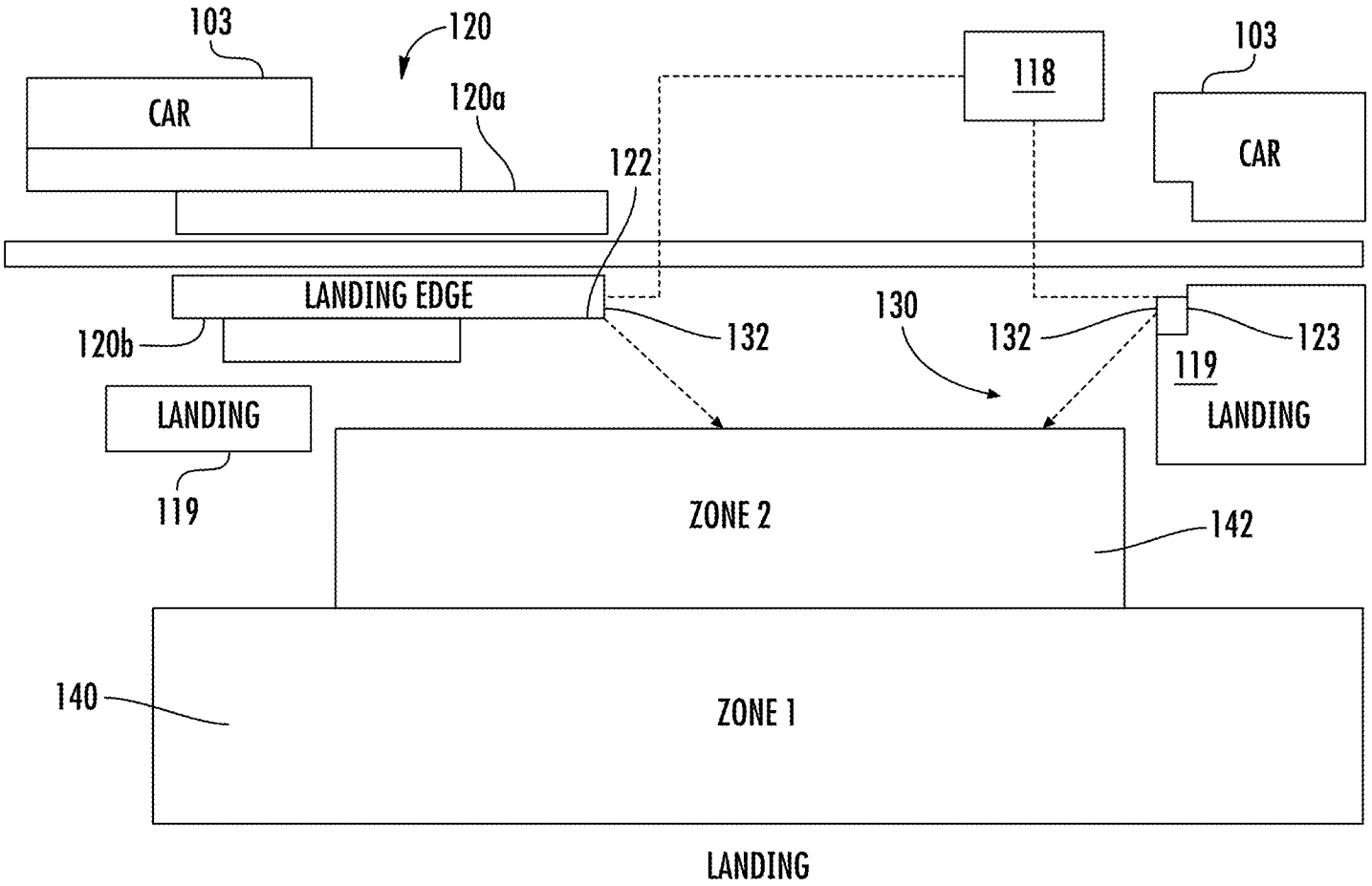
FIG. 2 is a schematic illustration of a zone object detection system associated with the elevator system.

Referring now to FIG. 2, a top plan view of an environment associated with loading and unloading of the elevator car 103, such as a building lobby or floor landing area (referred to herein as a "landing 119"), is shown. FIG. 2 illustrates a portion of the elevator car 103, a landing 119, and an elevator door 120. The elevator door 120 refers to a tandem door system that includes an elevator car door 120*a* and a landing area door 120*b* in some embodiments. The embodiments described herein may be applied to either door and for ease of understanding, the doors 120*a*, 120*b* are collectively referred to as the elevator door 120. In the illustrated embodiment, the elevator car 103 includes a single elevator door 120 that may be translated between an opened position and a closed position. In such an embodiment, a leading edge 122 of the door 120 moves toward a wall 123 of the landing 119 during a closing action and away from the wall 123 during an opening action. It is to be appreciated that some embodiments include two doors 120 that move in the same direction one relative to the other toward a wall 123 of the landing 119 during a closing action, and away from wall 123 during an opening action. Moreover, some embodiments may include two doors 120 that move toward each other door during a closing action and away from each other door during an opening action.

A zone object detection system 130 is schematically illustrated in FIG. 2. As one will appreciate from the disclosure herein, the zone object detection system 130 modifies behavior/operation of the elevator door(s) 120 based on zone recognition, and transitions of objects between multiple zones in some embodiments. Various modes of door behavior modification are contemplated and are described in detail herein.

Although the illustrated embodiment pertains to an elevator door 120, it is contemplated that any type of automated door that opens and closes in response to passengers entering or exiting a compartment may benefit from the embodiments described herein. For example, a train (e.g., subway car or large passenger train), building entrance/exit, and any other automated door system may utilize the embodiments described herein.

The zone object detection system 130 includes one or more sensors 132 that monitor one or more zones that are in and/or out of the elevator door plane. In systems where multiple sensors are employed, the sensors 132 may be a common type of sensor or varied. Any type of sensor suitable for moveable object detection may be employed. For example, sensors 132 that rely on infrared, radar, video, LIDAR, time of flight, floor pressure sensors, depth sensing, and suitable alternatives, may be utilized. The sensors 132 may be positioned in various locations. For example, the sensors 132 may be located on the floor of the landing 119, or at elevated positions fixed to a structure in the landing 119. In the illustrated embodiment, a sensor 132 is fixed to the elevator door 120 proximate the leading edge 122 of the door (which may be either or both of door 120*a*, 120*b*), and fixed to the landing wall 123. Other locations are certainly possible. Sensors 132 in multi-zone detection systems can be tandem sensors designed to send signals in parallel, or can be video systems that determine passenger intent in real time, sending multiple signals to a door controller 118 as a passenger or object approaches. It will be appreciated that door controller 118 can be part of the control system 116 (See FIG. 1) and/or part of controller 115.

The illustrated embodiment of FIG. 2 shows two zones that are monitored, namely a first zone 140 and a second zone 142, with the second zone 142 being located closer to the elevator door 120, relative to the distance from the first zone 140 to the elevator door 120. The zones may be of any dimension (width, height and/or depth) suitable for a particular application of use, which may vary depending upon particular circumstances, including environment dimensions and geometry, door closing speed, door closing distance, door width, lobby size, etc. For example, the depth of the zone(s) may be up to a certain distance (e.g., up to 20 inches from elevator door 120) or may be a function of the width of the zone (e.g., 20% of the zone width); however, it is to be appreciated that each dimension may deviate from the non-limiting examples provided. Additionally, the sizes of the zones may vary from each other. For example, the zone closest to the elevator door 120 may be approximately the width of the elevator door 120, but the zone(s) e.g., 140, further from the elevator door 120 may be wider than the closer zone e.g., 142 to monitor a broader path that may include objects moving toward the elevator door 120 at various angles. In a non-limiting embodiment, the more distant zone may be up to 20% wider than the closer zone, but this relative dimensioning may vary.

Regardless of the zone sizes and dimensions relative to each other, the sensors 132 monitor the zones 140, 142 to detect objects located within, and moving within, either of the zones. The sensors 132 are in operative communication with the door controller 118 to determine the elevator door's 120 response to incoming passengers. In one embodiment, if a person is detected within the first zone 140 during a closing action of the elevator door 120, the controller 118 will command the elevator door 120 to slow down from its normal closing speed. A reduction in closing speed better prepares the elevator door 120 for stopping and/or reversing, if needed. If the person continues to approach the elevator door 120 and enters the second zone 142, the controller 118 stops and/or reverses the already slowed door movement, as the detection of a presence in the second zone 142 is perceived as an oncoming passenger. The embodiment described above reduces potential issues with immediate reversal of an elevator door 120 that is closing at full speed, thereby reducing the likelihood of impact with the person or object entering the elevator car 103.

As one can appreciate, more than two zones may be defined and monitored by the zone object detection system 130 disclosed herein. In particular, a multi-stage slowing of the elevator door 120 may be present, with slowing of a closing door to a first reduced speed, relative to full closing speed, if a person is in a first zone, and subsequent slowing to even slower closing speeds if the person enters one or more closer zones 142. Stopping and reversing the door closing movement may be additional commands that occur subsequent to slowing over one or more reduction speeds. Additionally, a single zone may be defined and monitored. In a single zone, slowing, stopping or reversal of the elevator closing may occur in response to detection of an object within the single zone.

Regardless of the number of zones defined and monitored, the total distance away from the elevator door 120 that is monitored may vary depending upon the particular requirements of a specific elevator system. In some embodiments, a distance of up to about 3 meters is monitored, but it is to be appreciated that other distances may be defined as the zone(s) for monitoring. In multi-zone embodiments, the total distance monitored may be broken up into the different zones in any distance combination considered desirable for the particular elevator system.

The embodiments described above relate to objects approaching the elevator door 120 from the landing area 119. However, it is to be appreciated that a reversed situation may be present in some embodiments. In particular, monitoring potentially exiting objects within the elevator car 103 may be provided in some embodiments. For example, one or more zones may be present in the interior of the elevator car 103 itself. Additionally, it is to be understood that any combination of interior zones and exterior zones may be provided. For example, one or more zones within the interior of the elevator car 103 may be combined with one or more zones at an exterior of the elevator car 103.

Monitoring for objects out of the plane of the elevator door 120 reduces the probability of passenger impact, as the system provides more time to slow, stop and/or reverse a closing door. This increases passenger safety and experience.

Figure 3:
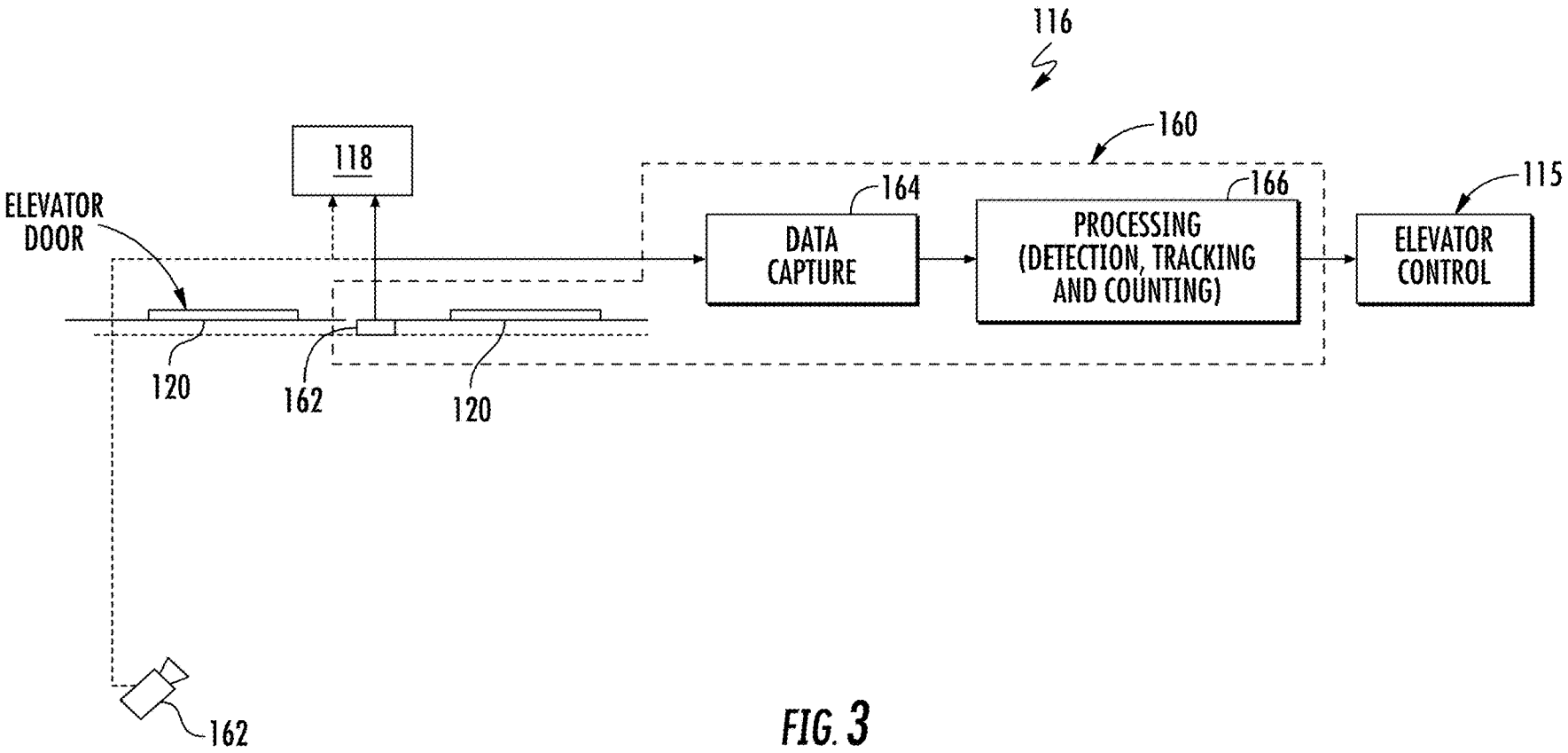
FIG. 3 is a depiction of a depth-sensor based passenger sensing system in accordance with one or more embodiments.

With reference to FIG. 3, a depth-sensor based passenger sensing system 160 can include a sensor 162 that communicates with a data capture module 164, and a processing module 166. The depth-sensor based passenger sensing system 160 can be a portion of the control system 116, a stand-alone unit, or other system such as a cloud-based system in communication with the control system 116. The data capture module 164, and the processing module 166 can be particular to the sensor 162 to acquire and process the data therefrom. In one example, the sensor 162, through the data capture module 164 and the processing module 166, is operable to obtain depth map data such as the presence of a passenger in a passenger waiting area or lobby, an estimated time of arrival (ETA) of the passenger at the landing 119, a number of passengers in the lobby H, etc.

The sensor 162, according to one disclosed non-limiting embodiment, can be installed in a lower portion of wall W of the lobby H such as at knee height (FIG. 1B). The sensors 162 may be a common type of sensor or varied as described herein. Any type of sensor 162 suitable for moveable object detection may be employed. For example, sensors 162 that rely on infrared, radar, video, LIDAR, time of flight, floor pressure sensors, depth sensing, and suitable alternatives, may be utilized. The sensors 162 may be positioned in various locations. The sensor 162 in this example disclosed non-limiting embodiment includes a depth-sensing sensor. It should be appreciated that the term "sensor," is used throughout this disclosure for any 1D, 2D, or 3D depth sensor, or combination thereof. Such a sensor can be operable in the optical, electromagnetic or acoustic spectrum capable of producing a depth map (also known as a point cloud or occupancy grid) of the corresponding dimension(s). Various depth sensing sensor technologies and devices include, but are not limited to, a structured light measurement, phase shift measurement, time of flight measurement, stereo triangulation device, sheet of light triangulation device, light field cameras, coded aperture cameras, computational imaging techniques, simultaneous localization and mapping (SLAM), imaging radar, imaging sonar, scanning LIDAR, flash LIDAR, Passive Infrared (PIR) sensor, and small Focal Plane Array (FPA), or a combination comprising at least one of the foregoing. Different technologies can include active (transmitting and receiving a signal) or passive (only receiving a signal) and may operate in a band of the electromagnetic or acoustic spectrum such as visual, infrared, etc. The use of depth sensing can have specific advantages over conventional 2D imaging. The use of infrared sensing can have specific benefits over visible spectrum imaging such that alternatively, or additionally, the sensor can be an infrared sensor with one or more pixels of spatial resolution, e.g., a Passive Infrared (PIR) sensor or small IR Focal Plane Array (FPA).

Notably, there can be qualitative and quantitative differences between 2D imaging sensors, e.g., conventional security cameras, and 1D, 2D, or 3D depth sensing sensors to the extent that the depth-sensing provides numerous advantages. In 2D imaging, the reflected color (mixture of wavelengths)

from the first object in each radial direction from the imager is captured. The 2D image, then, can include the combined spectrum of the source illumination and the spectral reflectivity of objects in the scene. A 2D image can be interpreted by a person as a picture. In 1D, 2D, or 3D depth-sensing sensors, there is no color (spectral) information; rather, the distance (depth, range) to the first reflective object in a radial direction (1D) or directions (2D, 3D) from the sensor is captured. 1D, 2D, and 3D technologies may have inherent maximum detectable range limits and can be of relatively lower spatial resolution than typical 2D imagers. The use of 1D, 2D, or 3D depth sensing can advantageously provide improved operations compared to conventional 2D imaging in their relative immunity to ambient lighting problems, better separation of occluding objects, and better privacy protection. The use of infrared sensing can have specific benefits over visible spectrum imaging. For example, a 2D image may not be able to be converted into a depth map nor may a depth map have the ability to be converted into a 2D image (e.g., an artificial assignment of contiguous colors or grayscale to contiguous depths may allow a person to crudely interpret a depth map somewhat akin to how a person sees a 2D image, it is not an image in the conventional sense). This inability to convert a depth map into an image might seem a deficiency, but it can be advantageous in certain analytics applications disclosed herein.

The sensor 162 can be, in one example, an eye-safe line-scan LIDAR in which the field-of-view (FOV) can be, for example, about 180 degrees, which can horizontally cover the entire area of a lobby or other passenger area adjacent to the elevator doors 103 (FIG. 1). The output of the LIDAR may, for example, be a 2D horizontal scan of the surrounding environment at a height where the sensor 162 is installed. For an active sensor, each data point in the scan represents the reflection of a physical object point in the FOV, from which range and horizontal angle to that object point can be obtained. The scanning rate of LIDAR can be, for example, 50 ms per scan, which can facilitate a reliable track of a passenger. That is, before application of analytic processes via the processing module 166, the LIDAR scan data can be converted to an occupancy grid representation. Each grid represents a small region, e.g., 5 cm×5 cm. The status of the grid can be indicated digitally, e.g., 1 or 0, to indicate whether each grid square is occupied. Thus, each data scan can be converted to a binary map and these maps then used to learn a background model of the lobby, e.g. by using processes designed or modified for depth data such as a Gaussian Mixture Model (GMM) process, principal component analysis (PCA) process, a codebook process, or a combination including at least one of the foregoing.

The processing module 166 may utilize various 3D detection and tracking processes (disclosed elsewhere herein) such as background subtraction, frame differencing, and/or spurious data rejection that can make the system more resistant to spurious data. Such spurious data can be inherent to depth sensing and may vary with the particular technology employed. For active techniques, where a particular signal is emitted and subsequently detected to determine depth (e.g., structured light, time of flight, LIDAR, and the like) highly reflective surfaces may produce spurious depth data, e.g., not the depth of the reflective surface itself, but of a diffuse reflective surface at a depth that is the depth to the reflective surface plus the depth from the reflective surface to some diffusely reflective surface. Highly diffuse surfaces may not reflect a sufficient amount of the transmitted signal to determine depth that may result in spurious gaps in the depth map. Even further, variations in ambient lighting, interference with other active depth sensors or inaccuracies in the signal processing may result in spurious data.

Continuing with FIG. 3, the sensors 162 are in operative communication with the door controller 118 to determine the elevator door's 120 response to approaching and incoming passengers. In an embodiment, the sensors 162 are employed to determine a state of urgency of an approaching passenger, passenger at the landing, or even passenger in the elevator car 103. Determining state of urgency can be based on multiple factors including the speed at which a passenger is approaching the elevators 101, and the distance of that person from the elevator door 120, as well as other operational factors such as the frequency or rapidity with which a button is being pressed. Other reasons and factors for adjusting the door movement may include, but not be limited to capacity of the elevator car 103, size of an approaching group of passengers, passengers requiring assistance, approaching passenger is a child, e.g., want to ensure their hand is not pinched in the door, an approaching passenger is or has a pet. Finally another factor for controlling the door movement may include whether the door has been reversed already.

In another embodiment it may include a passenger's pace, gait, and any other information regarding the approaching passenger that can be inferred from the sensors 162, depending on the type of sensors employed. In one embodiment, if a person is detected exhibiting a walking speed in in excess of a first threshold at a distance less than a predetermined threshold, the timing of the closing of the doors may be adjusted. That is, under such conditions, it is inferred that the passenger is intending to board the elevator car 103 and the timing of the closure of the elevator doors 120 is delayed based on the speed and distance of the approaching passenger. In an another embodiment if the a person is detected exhibiting a walking speed in in excess of a first threshold and yet within a predetermined distance from the elevator door 120 during a closing action of the elevator door 120, the controller 118, 115 will command the elevator door 120 to slow down from its normal closing speed. The speed to which the closing is slowed is based on the speed and distance of the approaching passenger. For example, in an embodiment, depending on the type of motor employed in the door controller different speed control techniques are employed. In one embodiment the motor is a stepper motor and the frequency of the motor drive would change the speed of the motor. In another embodiment, a DC motor may be employed and standard pulse width modulation techniques may be employed. A reduction in closing speed better prepares the elevator door 120 for stopping and/or reversing, if needed yet minimizes any additional delay for the currently boarded passengers. If the person continues to approach the elevator door 120 the controller 118 may stop and/or reverse the already slowed door movement, if the speed and distance of the approaching passenger indicates that the closing doors 120 would obstruct the entry of the approaching passenger. The embodiment described above reduces potential issues with immediate reversal of an elevator door 120 that is closing at full speed, thereby reducing the likelihood of impact with the person or object entering the elevator car 103.

In another embodiment a state of urgency can be inferred from other operational factors associated with the elevator system 100. For example, state of urgency for an approaching passenger, passenger at a landing, or even passenger in an elevator car 103 can be inferred by the frequency, rapidity and duration of button presses by a user. For example if a passenger is rapidly pressing the hall call buttons for a selected duration the door closing timing may be extended and/or the rate of door closure reduced. In an embodiment the operation factors may be sensed by existing sensors and device in the elevator system e.g. button presses and their timing or they may be acquired via other sensors, for example, cameras as part of the passenger sensing system 160.

As one can appreciate, multiples speed thresholds and distance thresholds may be defined and monitored by the passenger sensing system 160 disclosed herein. In particular, a dynamic slowing of the elevator door 103 may be present, with slowing of a closing door to a first reduced speed or continuously reducing speed, relative to full closing speed, if the speed and distance of an approaching person indicates an intent to board the elevator car 103. Furthermore, stopping and reversing the door closing movement may be employed based on the approaching passenger's speed and distance, button presses and the like as well as various thresholds associated with each. For example, in one embodiment, the thresholds may be variable based on locations around the world and likely variable depending on times of the day. As well, augmentation of behavior with different alarm systems would be ideal, e.g., the doors 120 might behave differently if there was a fire alarm going off, or other urgency is identified in the building. In another example, the thresholds could be average speed*1.5 would be considered a "walking fast" threshold, and therefore, adjust motor gains to 75% of max motor current, while an average speed*2 would be considered "running" threshold, and therefore, adjust motor gains to max current of the motor. Likewise, average speed*0.5 would be "slow" threshold, and thus adjust speeds 50% slower. Regardless of the predetermined thresholds for the passengers walking speed and distance, the total distance away from the elevator door 120 that is monitored may vary depending upon the particular requirements of a specific elevator system 101. In some embodiments, a distance of up to about 3 meters is monitored, but it is to be appreciated that other distances may be defined depending on the sensors employed. In some embodiments, the total distance monitored may also be broken up into the different zones in any distance combination considered desirable for the particular elevator system. For example, a person with the speeds such as described above in zone 1 may have the door responses above at a 75% level, while persons in zone 2 with the above speeds would have the speeds above. Moreover, a user running in zone 2, it may be desirable to reverse the doors 120 and open them immediately.

The embodiments described above relate to objects approaching the elevator door 103 from the landing area 119. However, it is to be appreciated that a reversed situation may be present in some embodiments. In particular, monitoring potentially exiting objects within the elevator car 103 may be provided in some embodiments. For example, one or more sensors may be present in the interior of the elevator car 103 itself to facilitate determining characteristics regarding the elevator car 103, such as loading, crowdedness, occupancy and the like. Additionally, it is to be understood that any combination of interior sensors and exterior sensor may be provided. For example, sensing within the interior of the elevator car 103 may be combined with sensing at an exterior of the elevator car or even beyond in the landing area 119.

Monitoring for objects out of the plane of the elevator door 120 reduces the probability of passenger impact, as the system provides more time to slow, stop and/or reverse a closing door 120. This increases passenger safety and experience.

Figure 4:
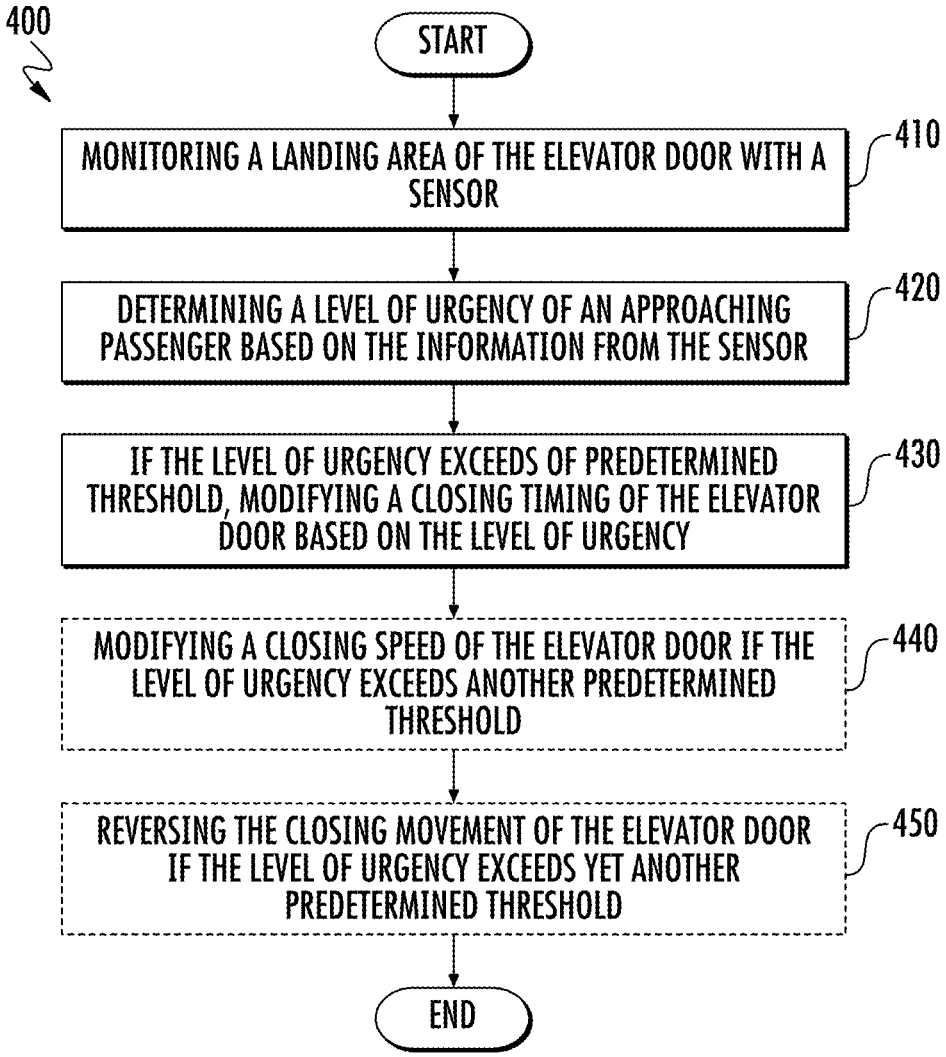
FIG. 4 is a flowchart depicting a method of controlling a movable door in accordance with an embodiment.

Turning now to FIG. 4 depicting a flowchart of the method 400 of controlling a movable door 120 associated with a passenger compartment in accordance with an embodiment. In the described embodiments, the door 120 is moveable between an opened position and a closed position configured to provide access to, or egress from, the passenger compartment. The method 400 is initiated at process step 410 with monitoring a landing area 119 of the elevator door with a sensor 162. As described herein the sensor can be of various types including infrared, optical, depth, time of flight, or similar sensor 162 as described herein. At process step 420, the method 400 continues with determining a level of urgency of an approaching passenger based on the information from the sensor. Levels of urgency can included speed and distance of the approaching passenger from the door 120, in some embodiments, it may also include pace or gait, and other bodily movements. If the level of urgency exceeds a predetermined threshold, wherein the level of urgency is based on at least one of the speed of the approaching passenger and distance of the approaching passenger from the elevator door 120, modifying a closing timing of the elevator door 120 based on the level of urgency as depicted at process step 430. Optionally, the method 400 may also include modifying a closing speed of the elevator door if the level of urgency exceeds another predetermined threshold as depicted at process step 440. Further still, the method 400 may optionally also includes reversing a closing movement of the elevator door 120 if the level of urgency exceeds yet another predetermined threshold as depicted at process step 450.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A passenger detection system for controlling a movable door associated with a passenger compartment, comprising:

a door moveable between an open position and a closed position and configured to provide access to, or egress from, the passenger compartment;

at least one sensor monitoring an area in proximity to the door; and a controller in operative communication with the at least one sensor and the door, the controller determining a level of urgency of an approaching passenger based on the information from the at least one sensor, and if the level of urgency exceeds a first predetermined threshold, modifying a closing of the elevator door based on the level of urgency;

further including the controller performing at least one of:

modifying a closing speed of the elevator door if the level of urgency exceeds a second predetermined threshold; and reversing a closing movement of the elevator door if the level of urgency exceeds a third predetermined threshold.

2. The passenger detection system of claim 1, wherein the modifying a closing of the elevator door includes at least one of: changing timing of closing movement, reducing a speed of the door closing movement, stopping the door closing movement, and reversing the door closing movement.

3. The passenger detection system of claim 2, wherein the modifying a closing timing includes delaying a closing movement of the door.

4. The passenger detection system of claim 1, wherein the at least one sensor is at least one of an infrared sensor, a radar sensor, a video sensor, a time of flight sensor, depth sensor, and a LIDAR sensor.

5. The passenger detection system of claim 1, wherein the area the at least one sensor is monitoring is an exterior of the passenger compartment.

6. The passenger detection system of claim 1, wherein the area the at least one sensor is monitoring is an interior of the passenger compartment.

7. The passenger detection system of claim 1, wherein the level of urgency is based on at least one of the speed of the approaching passenger, distance of the approaching passenger from the elevator and button press frequency and duration, and the gait or pace of the approaching passenger.

8. The passenger detection system of claim 1, wherein the passenger compartment is an elevator car and the door is an elevator door.

9. The passenger detection system of claim 1, wherein the at least one sensor is fixed to one of the elevator door, the leading edge of the elevator door, and a fixed structure in a landing area located proximate the elevator door.

10. A method of controlling a movable door associated with a passenger compartment, the door moveable between an opened position and a closed position configured to provide access to, or egress from, the passenger compartment the method comprising:

monitoring a landing area of the elevator door with at least one sensor;

determining a level of urgency of an approaching passenger based on the information from the at least one sensor; and if the level of urgency exceeds a predetermined threshold, modifying a closing of the elevator door based on the level of urgency;

further including at least one of:

modifying a closing speed of the elevator door if the level of urgency exceeds a second predetermined threshold; and reversing a closing movement of the elevator door if the level of urgency exceeds a third predetermined threshold.

11. The method of controlling a movable door of claim 10, wherein the modifying a closing of the elevator door includes at least one of: changing timing of closing movement, reducing a speed of the door closing movement, stopping the door closing movement, and reversing the door closing movement.

12. The method of controlling a movable door of claim 11, wherein the modifying a closing timing includes delaying a closing movement of the door.

13. The method of controlling a movable door of claim 10, wherein the at least one sensor comprises at least one of an infrared sensor, a radar sensor, a video sensor, a time of flight sensor, a depth sensor, and a LIDAR sensor.

14. The method of controlling a movable door of claim 10, wherein the monitoring is of a landing area located at an exterior of the passenger compartment.

15. The method of controlling a movable door of claim 10, wherein the monitoring is of a landing area located at an interior of the passenger compartment.

16. The method of controlling a movable door of claim 10, wherein the level of urgency is based on at least one of the speed of the approaching passenger, distance of the approaching passenger from the elevator and button press frequency and duration, gait or pace of the approaching passenger.

17. The method of controlling a movable door of claim 10, wherein the passenger compartment is an elevator car and the door is an elevator door.

18. The method of controlling a movable door of claim 10, wherein the at least one sensor is fixed to one of the elevator door, the leading edge of the elevator door, and a fixed structure in a landing area located proximate the elevator door.

* * * * *